United States Patent [19]

Mojden et al.

[11] Patent Number: 4,727,991

[45] Date of Patent: Mar. 1, 1988

[54] SCROLL STRIP CONVEYOR SYSTEM

[75] Inventors: Wallace W. Mojden; Andrew E. Mojden, both of Hinsdale, Ill.

[73] Assignee: Fleetwood Systems, Inc., Ill.

[21] Appl. No.: 794,042

[22] Filed: Nov. 1, 1985

[51] Int. Cl.[4] ..... B07C 5/342

[52] U.S. Cl. ..... 209/588; 198/367; 198/690.1; 209/657; 209/904; 209/933; 271/193; 271/305; 271/901; 414/35; 414/74; 414/103

[58] Field of Search ..... 209/559–566, 209/576–578, 586–588, 598, 636, 656, 657, 904, 907, 933, 934; 198/635, 367, 442, 690.1; 271/18.1, 193, 303, 305, 307, 901, 297; 414/35, 103, 74, 75

[56] References Cited

U.S. PATENT DOCUMENTS

| | | | |
|---|---|---|---|
| 1,282,626 | 10/1918 | Powers | 271/305 |
| 2,312,357 | 3/1943 | Odquist et al. | 209/561 |
| 2,527,911 | 10/1950 | Buccicone et al. | 198/690.1 X |
| 2,533,422 | 12/1950 | Braun | 271/305 |
| 2,570,288 | 10/1951 | Todd | 209/933 X |
| 2,609,928 | 9/1952 | Doust | 209/657 X |
| 2,640,605 | 6/1953 | Chatterton | 271/193 X |
| 2,697,514 | 12/1954 | Stahl | 209/657 X |
| 2,736,431 | 2/1956 | Coleman et al. | 209/564 |
| 2,795,340 | 6/1957 | Hommel | 414/35 |
| 3,051,479 | 8/1962 | Gore | 271/193 |
| 3,307,716 | 3/1967 | Ross | 414/35 |
| 3,672,663 | 6/1972 | Tomlinson | 271/303 |

FOREIGN PATENT DOCUMENTS

| | | | |
|---|---|---|---|
| 0009014 | 3/1980 | European Pat. Off. | 414/35 |

*Primary Examiner*—Robert B. Reeves
*Assistant Examiner*—Edward M. Wacyra
*Attorney, Agent, or Firm*—Trexler, Bushnell, Giangiorgi & Blackstone, Ltd.

[57] ABSTRACT

A scroll strip conveyor system comprises a conveyor belt for carrying a series of relatively flat scroll strips thereon in a flat, edge-to-edge spaced apart condition. An inspection station is located along the conveyor for inspecting the scroll strips to identify rejects. An ejector is provided for ejecting the rejects from the conveyor belt. A hopper feed apparatus is located at a terminal end of the conveyor belt for receiving the scroll strips therefrom one by one in an edge-to-edge condition and for redirecting the scroll strips into a parallel surface-to-surface spaced apart condition to be stacked in flat, surface-to-surface abutting condition in a hopper.

32 Claims, 9 Drawing Figures

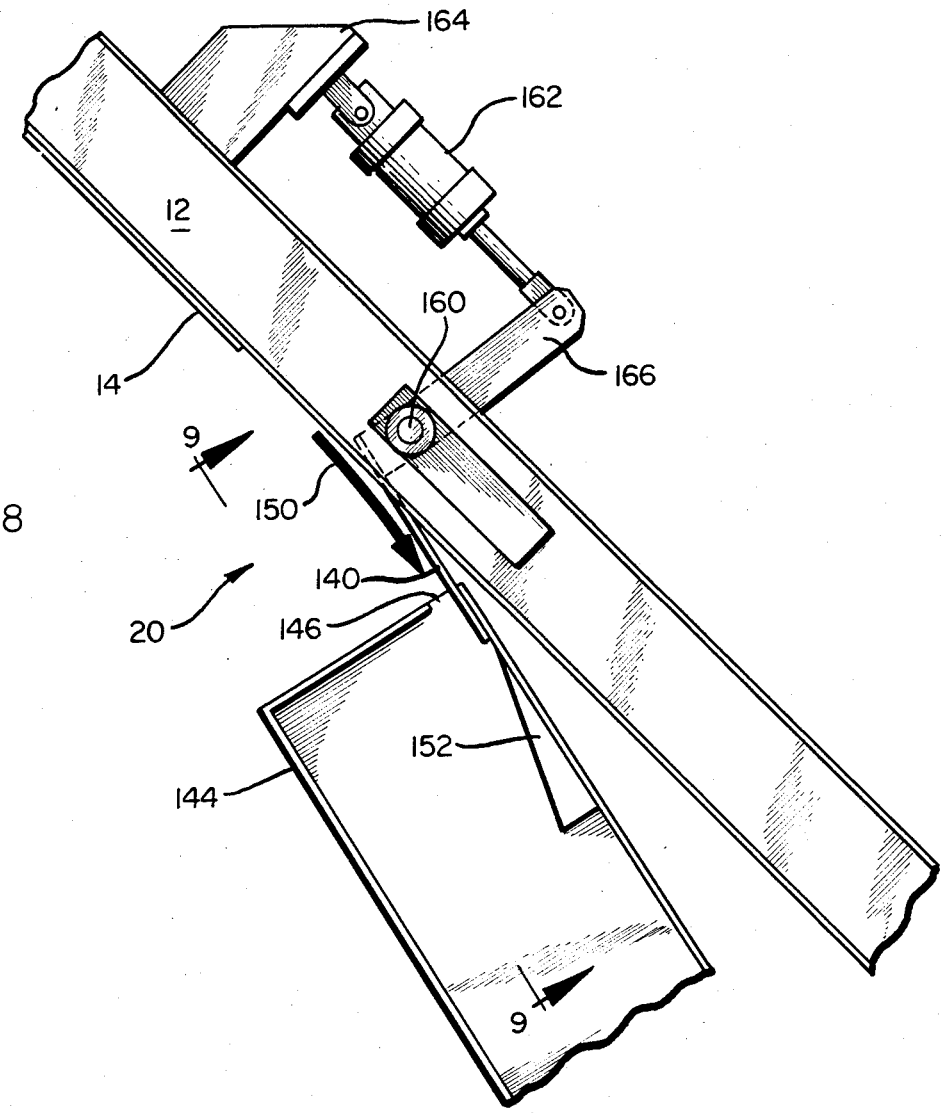
FIG. 8
FIG. 9
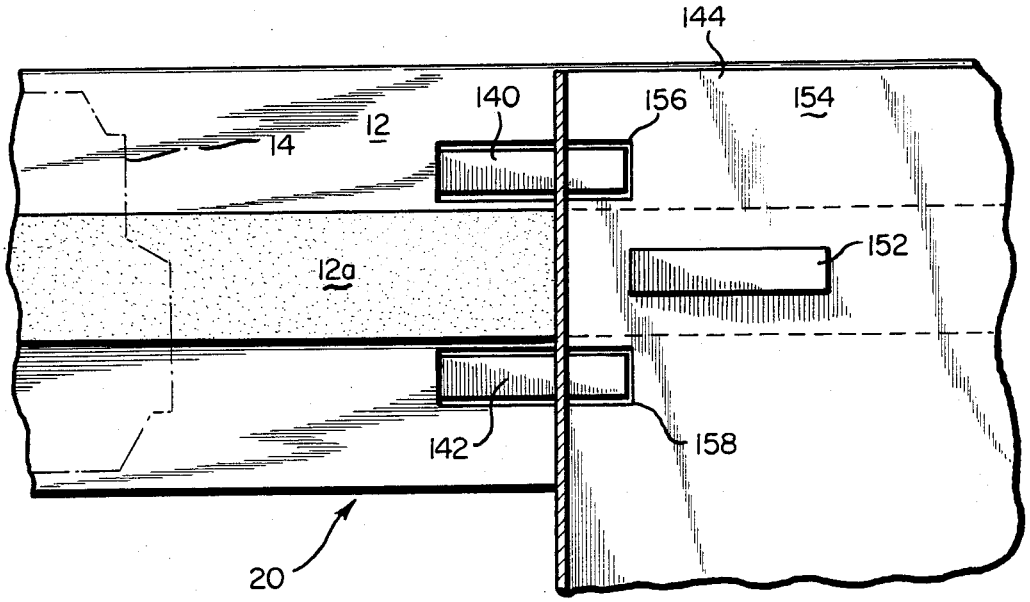

SCROLL STRIP CONVEYOR SYSTEM

BACKGROUND OF THE INVENTION

This invention is directed generally to the material handling and container formation arts, and more particularly to a scroll strip conveyor system for directing a plurality of scroll strips from machinery wherein they are initially formed or sheared from sheet stock material to a hopper, and to a novel strip handling or feed mechanism for stacking the scroll strips in the hopper. Preferably an inspection station and ejector mechanism is provided along the conveyor for detecting and ejecting rejects among the scroll strips.

Scroll strips of the type handled by the system of the invention are generally well-known in the container fabrication arts. These scroll strips comprise flat, preformed sheets of metallic material which are formed from sheet stock and are later otherwise formed into generally circular can ends. These flat, preformed scroll strips are formed with an irregular peripheral configuration to maximize the number of can ends that may be punched or otherwise formed therefrom and to minimize the amount of waste material, and as such are difficult to handle and convey.

An important consideration in fabrication of can ends is avoiding defects such as small holes in the finished ends. It has been found to be more efficient to initially inspect the scroll strips for any such holes or other irregularities prior to the formation of can ends therefrom. Since a plurality of can ends, for example from six to eighteen or more can ends may be formed from each strip, it will be appreciated that inspection of the strips, prior to formation of individual can ends therefrom can save a great deal of production and inspection time.

An additional problem arises with respect to the process of conveying the scroll strips from the shearing machine to the press or other machinery which forms the individual can ends. Preferably, the aforementioned inspection and ejection of rejects should take place while the scroll strips are being conveyed between the respective machines. In this regard the apparatus of the present invention utilizes a conveyor belt having suitable optical inspection and rejection stations therealong. It will be recognized that the scroll strips must be individually conveyed in a flat condition along the conveyor belt to enable such visual inspection. However, it is normally desired to stack the scroll strips in a flat, abutting surface-to-surface condition to be fed to the can end forming press for further processing. Further, the infeed station for the forming press also must accommodate an adequate supply of strips, so that the press need not be stopped should the shearing machine have to be shut down for service or repair.

One problem which has arisen with respect to the foregoing process is that of reorienting the scroll strips from their flat end-to-end condition, individually travelling along the conveyor belt to a stacked condition within a hopper at the infeed station of the forming press. When the flat scroll strips are merely ejected from the conveyor belt directly into a hopper or other container, their orientation becomes difficult or impossible to control. That is, the scroll strips generally do not remain in an upright or vertically oriented, parallel condition, but rather tend to tip or fall over. Generally speaking the infeed hopper is angled downwardly so as to facilitate stacking of the scroll strips therein by gravity. This angle of the hopper encourages further tilting or canting of the strips, whereby individual strips may tip over, causing jamming of the hopper and preventing proper stacking of the scroll strips therein or introduction of further scroll strips thereto.

OBJECTS AND SUMMARY OF THE INVENTION

Accordingly, it is a general object of the invention to provide a novel and improved scroll strip conveyor system which overcomes the foregoing problems of the prior art.

A more specific object is to provide a system in accordance with the foregoing object which provides a novel magnetic hopper feeding arrangement for reliably redirecting scroll strips from the conveyor belt into a stacked condition within a hopper or other container.

A related object is to provide a system in accordance with the foregoing objects which further includes means for inspecting the scroll strips to identify rejects as they travel along the conveyor and means for ejecting the rejects from the conveyor prior to reaching the hopper.

Briefly, in accordance with the foregoing objects, a hopper feed apparatus in accordance with the invention comprises feed means at a terminal end of a conveyor belt for receiving scroll strips therefrom one by one in an on-edge, serial fashion and for redirecting the scroll strips into a flat, abutting surface-to-surface stacked condition within a hopper.

In accordance with another aspect of the invention there is provided means for inspecting scroll strips to identify rejects and ejector means for ejecting the rejects identified by said inspecting means from a conveyor.

In accordance with yet another aspect of the invention, there is provided a scroll strip conveyor system including conveyor belt means for carrying a series of scroll strips thereon; and inspecting means, ejector means and hopper feed means in accordance with the above-described aspects of the invention.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in the several figures in which like reference numerals identify like elements, and in which:

FIG. 8 is an enlarged top plan view of a preferred form of ejector mechanism in accordance with the invention; and FIG. 9 is a view taken generally in the plane of the line 9—9 of FIG. 8.

DETAILED DESCRIPTION OF THE ILLUSTRATED EMBODIMENT

Figure 1:
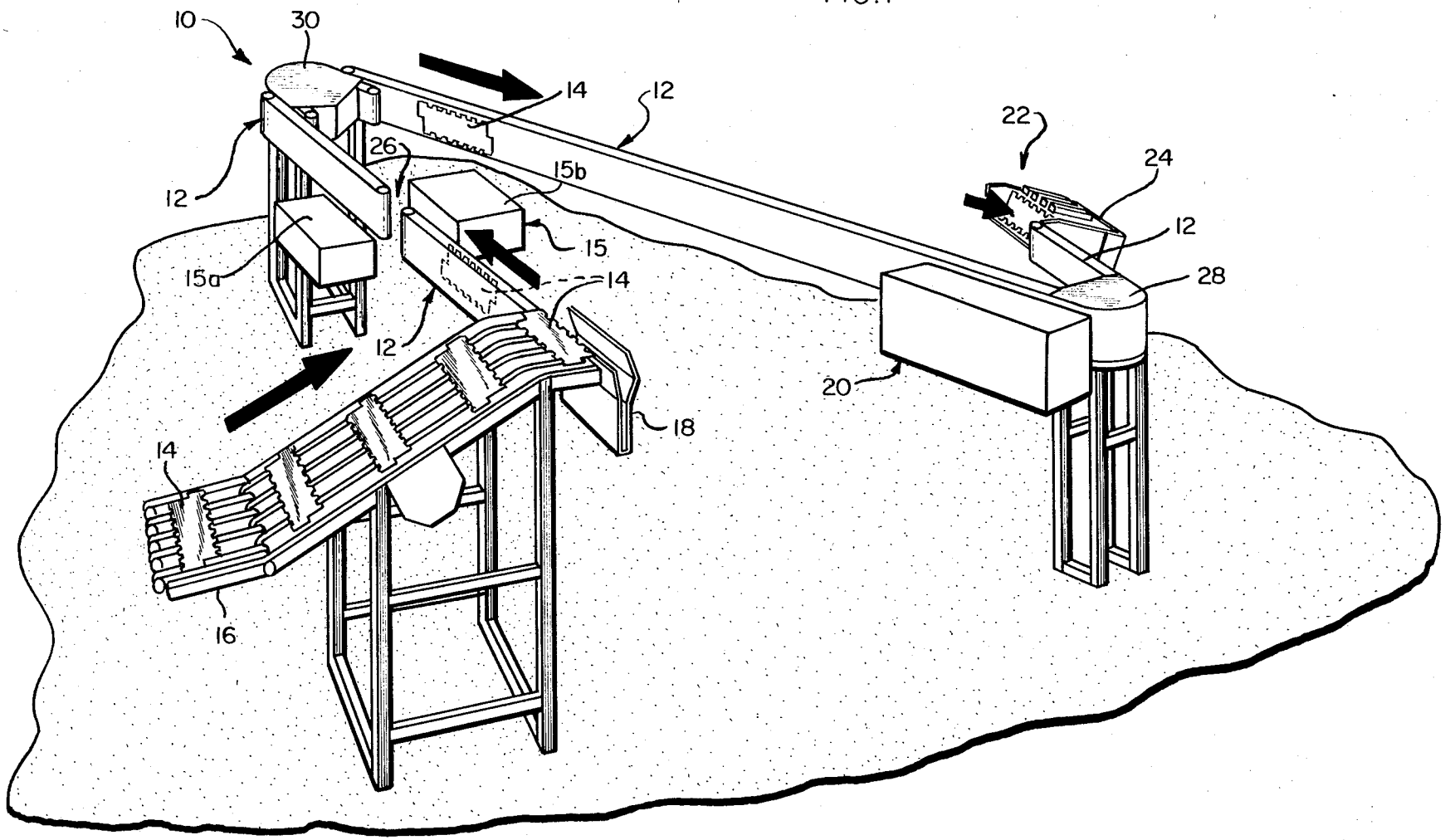
FIG. 1 is a perspective view, somewhat schematic in form, of a scroll strip conveyor system in accordance with a preferred form of the invention.
Figure 2:
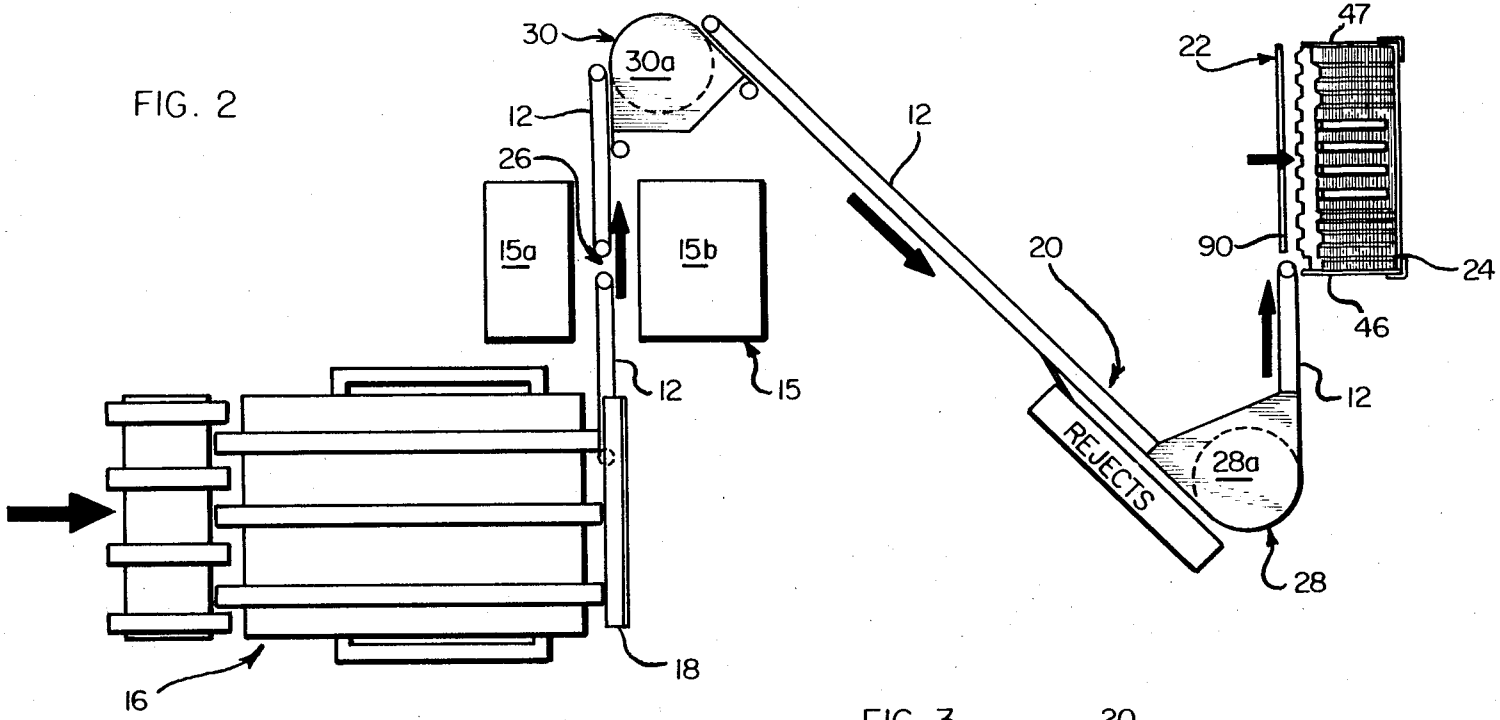
FIG. 2 is a top plan view of the system of FIG. 1.
Figure 3:
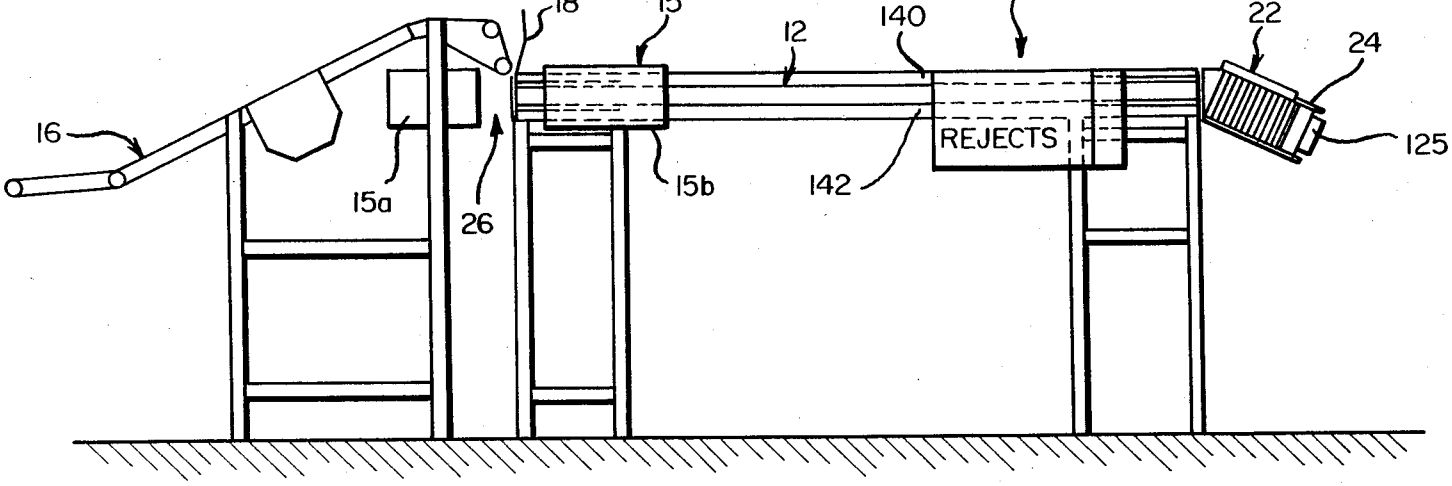
FIG. 3 is an end elevational view of the system of FIG. 1.

Referring now to the drawings and initially to FIGS. 1 through 3, a scroll strip conveyor system in accordance with the invention is designated generally by the reference numeral 10. It will be noted that FIGS. 1 through 3 are somewhat schematic or diagrammatic in form, while the remaining figures illustrate further details of certain structures utilized therein.

Generally speaking, the system 10 comprises a magnetic belt-type conveyor 12 for carrying a series of relatively flat scroll strips 14 thereon in a flat, spaced apart edge-to-edge or on-edge condition between the outfeed conveyor 16 of the shearing machine (not shown) and the hopper 24 at the infeed station of a can end forming press (also not shown). Preferably an inspecting station 15 is provided along the path of the conveyor 12 for inspecting the scroll strips 14 to identify rejects which are subsequentially ejected or rejected at reject station 20.

The scroll strips 14 are formed from thin sheet metal stacks and are configured with an irregular periphery, as shown, for permitting the later formation of a maximum number of generally circular can ends therefrom. Accordingly, it is considered most efficient to identify and reject any scroll strip 14 which has irregularities such as holes or the like therein, prior to formation of a plurality of individual can ends therefrom.

The scroll strips 14 are fed individually to the conveyor 12 by the conveyor 16 associated with the shearing machine and which forms no part of the invention. Suffice it to say that conveyor 16 delivers the individual scroll strips 14 one-by-one to a realigning or positioning hopper 18 through which an end portion of the conveyors 12 runs, see FIG. 2. This repositioning or aligning hopper 18 positions the scroll strips to be carried along the conveyor in the orientation illustrated. In this regard, the scroll strips are formed from a ferromagnetic material, whereby the conveyor 12 comprises a magnetic "on-edge conveyor" utilizing a series of driven conveyor belts engaged over stationary magnetics to maintain the scroll strips thereon and oriented in the manner illustrated. The structure of the magnetic conveyor arrangement 12 is well known, and as such is not illustrated and described in detail.

In accordance with another feature of the invention, a reject station 20 is provided along the conveyor 12 for ejecting the rejected strips 14, identified at inspection station 15 from the conveyor prior to delivery of the scroll strips to the press machinery for processing into individual can ends. The reject station 20 is located farther along the conveyor belt than the inspection station 15 with respect to the direction of travel of the scroll strips 14 along the magnetic belt conveyor 12.

It will also be noted that in the illustrated embodiment one or more cornering or redirecting means 28, 30 may be utilized intermediate various segments of the belt conveyor 12 so as to redirect the relatively flexible scroll strips 14 therebetween, thereby to conserve or minimize the space required for installation of the scroll strip conveyor system 10. Other arrangements may of course be utilized without departing from the spirit and scope of the invention. These members 28 and 30 generally comprise cylindrical drum-like magnetic roller members 28*a* and 30*a* which may be arranged at any desired angle relative to various segments of the belt conveyor 12 for guiding the scroll strips 14 therebetween.

In accordance with yet another feature of the invention, a receiving hopper-infeed arrangement 22 is located at an end of the belt conveyor 12 for receiving the scroll strips 14 therefrom one-by-one in their on-edge condition and for redirecting or reorienting the scroll strips into a parallel surface-to-surface condition so as to be stacked in a flat, surface-to-surface abutting condition in a hopper 24. The hopper 24 supplies the scroll strips 14 directly to the can end forming machinery. Alternatively, a stack of strips 14 may be removed and transported to another location for feeding of the scroll strips 14, which have now been inspected by the apparatus 15 described above and the detected rejects removed, to further processing or formation machinery.

Preferably, the inspection station 15 comprises an automated optical arrangement to facilitate optical inspecting of the scroll strips. As illustrated, inspection station 15 is located adjacent a gap or opening 26 in the belt conveyor 12 and generally comprises a light source 15*a* to one side of this gap 26 and a light sensing apparatus 15*b* to the opposite side. Accordingly, any through holes or apertures or other defects in the desired configuration of the scroll strips 14 may be ascertained from the amount of light received from the light source 15*a* at the light sensitive apparatus 15*b* as each scroll strip 14 passes across the gap 26. It will be appreciated that reflective sensor means may also be utilized in place of the "transmissive" type just described, without departing from the principles of the invention.

After passing the inspection station 15, the scroll strips are delivered to the reject station 20. Since the speed of the belt conveyor 12 is known and can be controlled, the rejecting mechanism at station 20, which will be discussed more fully hereinafter with respect to FIGS. 8 and 9, can be timed and operated to remove any improperly formed strip from the path of the conveyor 12.

Figure 4:
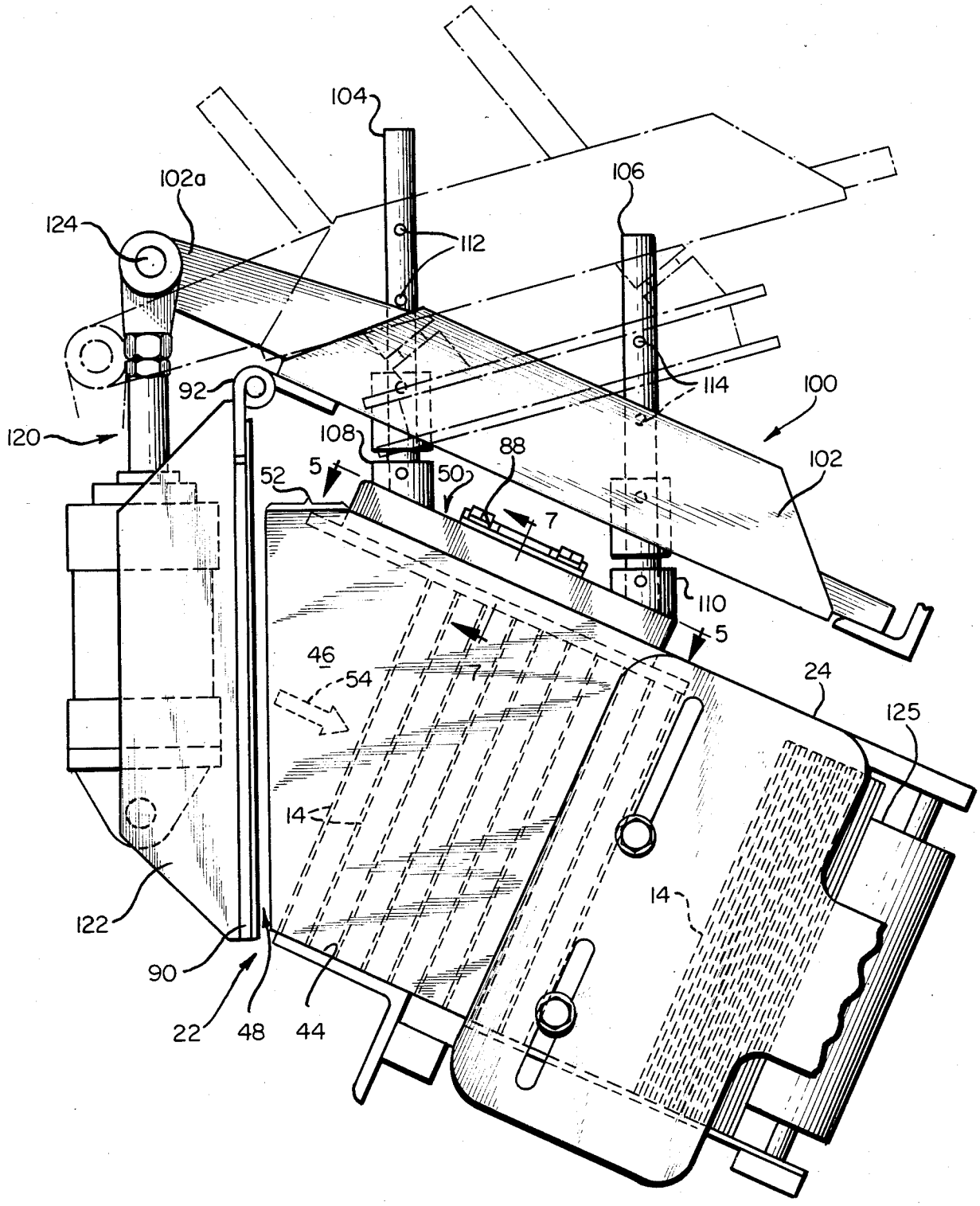
FIG. 4 is an enlarged side elevation of a hopper feed assembly in accordance with a preferred form of the invention.

Referring now to FIG. 4, additional details of the receiving hopper-infeed apparatus 22 in accordance with a preferred form of the invention are illustrated. This hopper feed means comprises an enclosure having means defining a bottom wall 44, and a pair of opposite side walls, one of these side walls 46 being seen in FIG. 4, it being understood that the opposite side wall 47 (see FIG. 2 for example) is substantially identical. However, the first side wall 46 defines an elongate, relatively thin entrance opening 48 for receiving individual, on-edge scroll strips therethrough from the belt conveyor 12. Morever, these three wall structures 44, 46 and 47 collectively define a cross-sectional configuration of the interior of the hopper-infeed apparatus 22 which is substantially similar to the maximum peripheral dimensions of the scroll strips 14. In this regard, it will be remembered that scroll strips 14 are irregularly shaped as illustrated in FIG. 1, for example, such that the scroll strips 14 may be introduced into the interior space defined by these walls in a substantially upright position, substantially perpendicular to all of the walls, as indicated by dashed lines in FIG. 4.

A magnetic strip alignment and position retention arrangement or means indicated generally by reference numeral 50 is provided for maintaining, redirecting and aligning the strips in the parallel and spaced apart condition illustrated in FIG. 4 within the hopper-infeed structure 22 such that the flat surfaces of the scroll strips are substantially perpendicular to the top, bottom and side walls as previously indicated. In the illustrated embodiment, the hopper-infeed assembly 22 further includes an entrance guide portion 52 which is generally canted or angled so as to define a generally downwardly angled orientation of the infeed assembly 22 and of the hopper 24 therebehind relative to the conveyor belt 12. This downwardly angled orientation generally facilitates the travel of the scroll strips through the hopper-infeed assembly 22 as indicated generally by arrow 54 and thereafter the holding of the scroll strips in a stacked condition in the hopper 24, by gravity.

Figures 5, 6, 7:
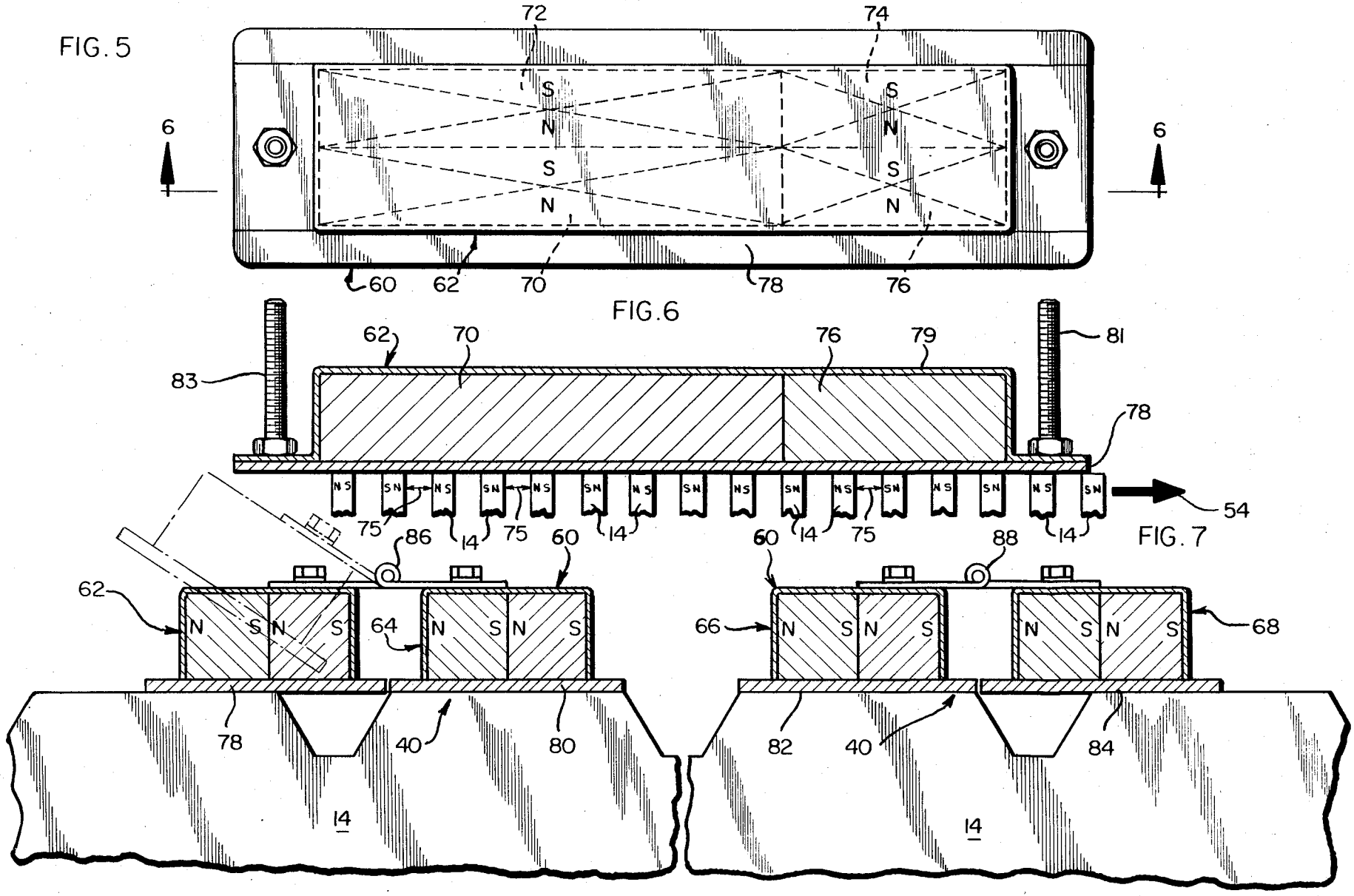
FIG. 5 is an enlarged partial view taken generally along the line 5—5 of FIG. 4.
FIG. 6 is a sectional view taken generally along the line 6—6 of FIG. 5.
FIG. 7 is an enlarged partial sectional view taken generally in the plane of the line 7—7 of FIG. 4.

Referring now also to FIGS. 5 through 7, the magnetic strip alignment and position retention structure 60 will be seen to include magnet means 60 adjacent the top portion of the infeed assembly 22, for magnetizing the scroll strips 14 so as to maintain them generally in the orientation illustrated in FIG. 4. That is, the scroll strips 14 are maintained in a parallel, spaced apart condition substantially perpendicular with the walls of the feed means or assembly 22 substantially along the extent thereof and at least up to an entrance of the hopper 24, which is attached at a remote or following end thereof with respect to the direction of travel of the strips 14. This magnet means 60, FIGS. 4–7, will be seen to comprise a plurality of elongate magnet members or assemblies 62, 64, 66 and 68 which in the illustrated embodiment are four in number. Each of these magnet members or assemblies, as best viewed in FIG. 5 for example, comprises a plurality of individual or discrete bar-type magnets 70, 72, 74 and 76, which have predetermined magnetic polarity orientations as indicated by the letters N and S in FIGS. 5 and 7, for maintaining the scroll strips in the condition illustrated in FIG. 4. The magnets 70, 72, 74 and 76 form a typical one 62 of the magnet assemblies, and are preferably arranged as illustrated within a generally rectilinear non-magnetic housing member 79 which is affixed to a non-magnetic plate 78 by suitable means such as threaded fasteners 81 and 83. While a plurality of said magnetic members are illustrated, it should be understood that a single magnetic member could be used. The magnetic assemblies 62–68 are disposed such that their respective N-S polarity extends transverse to the length of end plate 78 and the path of movement of the scroll along 14 therealong. The other end portions of the magnetic means are essentially neutral from a magnetic circuit standpoint.

With reference to FIG. 6, there is shown a longitudinal section of the magnetic assembly 62, with a series of scroll strips 14 being shown partially in end view. The magnetic arrangement and circuit established the magnets 70–76 with polarity, as shown is such that the metal scroll strips 14 will effectively be induced with magnetic polarities as generally indicated by the letters N and S in FIG. 6. The net effect is that the adjacent strips 14 are induced with opposite magnetic polarities so that they tend to repel each other as indicated by the arrows 75.

In addition the magnetic forces produced by the magnetic means 50 will cause the metal strips 14 to be attracted toward the individual assemblies 62–68 and drawn toward and into engagement with the non-magnetic plate 78.

Accordingly as will be explained, the addition of scroll strips 14 into the infeed-hopper assembly 22, will cause the strips already in the assembly 22 to be forced longitudinally toward the hopper 24. More specifically, as a strip 14 enters the assembly 22 it will come under the influence of the magnetic means 50 and will initially be attracted toward the non-magnetic plate 78. Further, the strip 14 will be induced with a magnetic polarity opposite to that of the precedings adjacent strip 14, such that the adjacent strips tend to repel each other. Also, it must be recalled that as shown in FIG. 4 the hopper-infeed assembly 22 and the magnetic assemblies 50 are slanted or disposed at an angle such that gravity forces tend to cause the strips to move inwardly, although the attraction of the strips to the magnetic assembler 50 prevent the strips 14 from toppling over. The net effect is that as a strip 14 enters the hopper-infeed assembly 22 is that the immediately adjacent strip 14 is forced a short distance along plate 78 toward hopper 78. This strip then repels the strip 14 adjacent thereto to produce similar movement. What occurs is essentially a chain-reaction with each strip repelling each adjacent strip and the strips moving along plate 78 toward and into the hopper 24.

Thus, with the illustrated orientation of hopper-infeed assembly 22 and the arrangement of the magnetic assemblies 50 the scroll strips 14 entering the assembly 22 will be held in a generally parallel, upright orientation and will be prevented from toppling over. Further, the respective scroll strips 14 will move along the plate 78 as additional strips 14 enter the hopper-infeed assembly 22, with the strips ultimately being deposited in the hopper 24 preparatory to delivery to a can end forming press. With this arrangement an adequate supply of scroll strips 14 can be stored in the hopper 24 and the infeed assembly, such that should the scroll strip shearing machinery fail or otherwise have its operation interrupted, the forming press can still operate for a significant period of time. Also, it can be appreciated that witho the employment of the strips 14 and magnetic means 60 to maintain the positioning of the strips 14, the strips would tend to toppel over and only a relatively small supply could be stored in the hopper 24.

In accordance with a preferred form of the invention as illustrated, selected ones of these magnet members 62, 64, 66 and 68 are mounted for pivotal movement toward and away from the area wherein the scroll strips 14 are received the upper limits of which are defined collectively by base portions 78, 80, 82 and 84 of the respective magnet members or assemblies. In the illustrated embodiment, it will be seen that magnet members or assemblies 62 and 66 are pivotally or hingedly mounted by hinge members 86, 88 to respective magnet assemblies 62 and 68 to achieve this movement relative to the top portions of the scroll strips 14, so as to selectively vary the overall magnetic forces applied thereto. In this regard, it has been found that with adjacent press machinery in operation, considerable vibrational forces are experienced at and within the hopper feed structure 22, such that all four of the magnet assemblies are generally required to maintain the desired orientation of the scroll strips. However, when the press machinery is not in operation, it has been found that the net magnetic force applied by all four of these magnet assemblies is generally too great to permit the desired movement of the scroll strips in the direction 54 for stacking in the hopper 24. Accordingly, by pivoting or hingedly moving two of these magnet members or assemblies away from the scroll strips under certain conditions permits both the desired orientation of the scroll strips and their continued movement for stacking within the hopper 24, even though the can end forming press is not operating.

In accordance with a further feature of the illustrated embodiment, the entire magnetic assembly 50 is mounted for movement away from the side walls 46 and 47 of hopper assembly 22 to permit access to the interior thereof. In the illustrated embodiment, the hopper feed means or assembly 22 also includes a front or forward wall portion 90 which is fixed relative to the side walls 46, 47 and bottom wall 44. In this regard the gap or opening 48 for introducing scroll strips into the assembly 22 is defined between this wall 90 and a facing edge portion of side wall 46. The wall 90 is thus located adjacent a terminal end of the conveyor belt system 12 and serves to guide the scroll strips into the hopper-infeed assembly 22 upon said strips leaving the belt conveyor 12. The wall 90 includes a hinge means or assembly 92 for pivotally or hingedly mounting the magnet assemblies 50 for movement toward and away from the top of assembly 22 to permit access to the interior thereof.

More specifically in this regard, the illustrated embodiment employs a further carrier means or assembly designated generally by reference numeral 100 and comprising a through apertured mounting or support bracket member 102 having a plurality of elongate rods 104, 106 slidably, adjustably extendable therethrough. These rods 104 and 106 are coupled to a top surface portion of respective magnet members or assemblies 64 and 68 by suitable fittings 108, 110. Suitable means such as spaced apart through apertures 112, 114 on the respective rods 104 and 106, with cooperating pins or other means (not shown) may be utilized to adjust the distance of the respective magnet members or assemblies 64 and 68 from an undersurface of carrier support member 102. Hence the effective height of all of the magnet assemblies and specifically of the undersurfaces thereof forming the upper limits of the scroll strip receiving area is adjustable with respect to the interior of the hopper-infeed assembly 22. This also permits selective variation of the effective interior height of the assembly 22 for accommodating scroll strips of different sizes. Suitable additional spacer means or assemblies (not shown) may also be utilized adjacent the interiors of side walls 46 and/or 47 to accommodate scroll strips of differing lengths.

In the illustrated embodiment, the carrier support member 102 is hingedly affixed to wall 90 by the hinge 92. Additional drive means in the form of a piston-and-cylinder assembly 120 is coupled intermediate a support strut member 122 to the wall 90 and pivotally coupled at 124 to an extension portion **102*a* of carrier support member 102 for pivotally moving carrier support member 102 and the attached magnet assemblies 50 about the hinge 92**.

It will be noted that the hopper 24, which is partially illustrated in FIG. 4, is illustrated with an additional conveyor or roller member 125 which receives individual scroll strips 14 therefrom for feeding or delivery to a forming press. However, this additional roller or other such feed structure forms no part of the invention and need not be utilized. Rather, the hopper 24 may be removable relative to assembly 22 for transport to some remote location for further processing of the scroll strips 14 contained therein.

Referring now to FIGS. 8 and 9, additional details of the reject means or assembly 20 in accordance with a preferred form of the invention are illustrated. The reject means or assembly 20 includes a pair of spaced apart ejector fingers 140, 142 which are mounted for movement between a rest position wherein there is no interference with the path of travel of the scroll strips 14 along the belt conveyor 12 and an eject position wherein the fingers extend into the path of travel of the scroll strips 14 along the belt conveyor. In the latter eject position, which is illustrated in FIG. 8, the fingers 140 and 142 extend generally at an angle from the conveyor 12 for redirecting the scroll strips away from the conveyor and toward a reject storage bin 144 adjacent the conveyor belt. In this regard, the conveyor belt will be seen to include a movable belt member **12*a* which is relatively narrow with respect to the width or height of the scroll strip 14 and height of the entire conveyor assembly 12 (as best viewed in FIG. 9). This belt 12*a* is also preferably centered with respect to conveyor belt assembly 12 and scroll strips 14 as they move therealong. Cooperatively, the ejector finger members 140 and 142 are placed to either side of the conveyor belt member 12*a* so as to permit movement of the belt 12*a* therebetween for in effect "peeling off" the scroll strip 14 when in the eject position illustrated in FIG. 8**.

Moreover, the reject bin is provided with an entrance opening 146 aligned with the ejector fingers 140 and 142 when they are in the eject position so as to receive the redirected scroll strips 14 therethrough as indicated by arrow 150. The reject bin also includes a guide member 152 adjacent to and somewhat behind the opening 146 so as to further aid in directing the scroll strips into the interior thereof. As best viewed in FIG. 8, this guide means comprises a wedge-shaped ramp-like structure which generally aligns with a remote outer end of the fingers 140 and 142 when in the eject position for generally receiving and guiding or directing the scroll strips therefrom into the interior of the reject bin 144.

Cooperatively in this regard, a rear wall portion 154 of the reject bin 144 includes a pair of through openings or apertures 156, 158, for receiving end portions of the respective ejector fingers 140 and 142 therethrough so as to guide or direct the scroll strips into the interior of bin 144 and along guide member 152 for some distance past the entrance or opening 146 thereof.

As best viewed in FIG. 8, the ejector finger means are pivotally mounted to a shaft 160. A suitable drive means or assembly is provided for driving the ejector fingers 140, 142 between the rest and eject positions thereof. This drive means includes a piston-and-cylinder assembly 162 which is coupled at one end thereof to a bracket 164 affixed to the rear of conveyor assembly 12 and at the other end thereof to an extension portion 166 of the fingers 140 and 142 which extends outwardly substantially at right angles thereto. In the illustrated embodiment, it is this extension member 166 which is pivotally mounted to shaft 160. The ejector finger members 140 and 142 are mounted to an end of extension 166 which extends somewhat to the side of shaft 160 opposite the connection thereof to piston-and-cylinder 162. The fingers 140 and 142 are thereby positioned relative to the surface of conveyor belt **12*a* so as to be generally coplanar with the surface of conveyor member 12 and just behind belt 12*a* when in the rest position, and so as to extend outwardly in the fashion illustrated in FIG. 8 when in the eject position, in response to respective extension and retraction of the piston-and-cylinder assembly 162**.

When the conveyor system 10 of the present invention is operating, scroll strips 14 will leave the shearing machine (not shown) and will be disposed upon conveyor 16 for delivery to a repositioning hopper 18. As can be seen in FIG. 2, the forward end of the magnetic belt conveyor 12 extends into the hopper 18. Thus as the strips 14 enter hopper 18 they attached to the belt conveyor 12 and will be transported along the path of said conveyor.

The strips 14 will pass the inspection station 15, and any irregularities or holes in the strip will be detected. The strip will move on to the reject station 20. Assuming the strip 14 has no imperfections, it will pass station 20 for delivery to the hopper-infeed assembly 22. Should imperfections be detected at inspection station 15, the reject mechanism, FIGS. 8 and 9, will be operated to direct the faulty strip into the reject bin 144.

Upon arriving at the hopper-infeed assembly 22, the strips 14 will exit the conveyor 12 and will be guided by the wall 90 into said assembly 22. As the strips enter the infeed assembly 22 they come under the influence of the magnetic field or fields established by the magnetic assemblies 50. Initially the strips will move inwardly at the infeed assembly 22 both under the influence of gravity, as infeed assembly 22 is disposed at a angle to the horizontal, and also that of the magnetic field within said assembly. The strips 14 will be attracted toward the magnetic assembly 50, and will be attracted toward the properties asssembly 50, and will be induced with the opposite magnetic polarities as discussed above.

The magnetic assemblies 50 will maintain the strips 14 in the desired orientation, with the entry of each succeeding strip 14 into infeed assembly 22 causing the previously received strips to move along the length of the assembly 22 toward and into hopper 24. The strips 14 will move along the length of the magnetic assemblies due in part to the repelling forces 75 and gravity. As the strips reach the end of the magnetic assemblies 50 they exit the magnetic field and will fall under the influence of gravity into hopper 24 for delivery to the can end forming press (not shown) by the conveyor 125, FIG. 4.

Thus, with the system 10 of the present invention an adequate and continuous supply of strips 14 are provided for the can end press. Further, should the shearing mechanism fail, the system 10 can be operated to purge the belt conveyor 12 of scroll strips 14, which will be delivered to the hopper 24. Thus, failure of the shear press does not require immediate stoppage of the still frictional can end forming press. Further, should the can end forming press fail, the system 10 can continue to operate for a considerable period of time to deliver scroll strips 14 to hopper-infeed 22 and hopper 24.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A scroll strip conveyor system comprising: conveyor belt means for carrying a series of relatively flat scroll strips thereon in a flat, edge-to-edge spaced apart condition; means for inspecting said scroll strips to identify rejects; reject means for ejecting said rejects from said conveyor belt means; and hopper feed means located at a terminal end of said conveyor belt means for receiving said scroll strips therefrom one by one in said edge-to-edge condition and for redirecting said scroll strips into a parallel, surface-to-surface spaced apart condition to be stacked in flat, surface-to-surface abutting condition in a hopper; wherein said hopper feed means comprises; an enclosure having a bottom wall and a pair of opposite side walls, said walls collectively defining a cross-sectional configuration similar to the maximum peripheral dimension of said scroll strips; entrance opening means for receiving said strips on edge from said conveyor; and strip alignment means for redirecting said strips to said parallel spaced apart condition within said hopper feed means, such that the flat surfaces of said scroll strips are substantially perpendicular to said bottom and side walls.

2. A system according to claim 1 wherein said inspection means includes means for optically inspecting said scroll strips to identify rejects.

3. A system according to claim 1 wherein said ejector means is located after said inspecting means with respect to the direction of travel of said conveyor belt means.

4. A system according to claim 1 wherein said hopper feed means further includes an entrance guide portion defining a downwardly angled orientation of said hopper feed means and of the hopper relative to said conveyor belt means so as to facilitate the directing to and holding of said scroll strips in a stacked condition in said hopper by gravity.

5. A system according to claim 1 wherein said strip alignment means comprises magnet means positioned adjacent the upper regions of said enclosure defined by said bottom and side walls and arranged with predetermined magnetic polarity orientations for magnetizing the scroll strips in such a manner so as to maintain said strips in said parallel, spaced apart condition substantially perpendicular with the bottom and side walls of said hopper feed means, substantially along the extent of said hopper feed means and at least up to an entrance of said hopper.

6. A system according to claim 5 wherein said magnet means comprises a plurality of elongate magnet members aligned with the direction of travel of said scroll strips through said hopper feed means and arranged in a parallel spaced apart condition and substantially parallel with said side walls, and each said magnet member having its N-S polarity disposed transversely to the path of movement of the scroll strips and longitudinally of the length of said strips as positioned in said hopper feed means.

7. A system according to claim 6 wherein at least selected ones of said magnet members are mounted for movement toward and away from said scroll strips so as to selectively vary the net magnetic forces applied to said scroll strips.

8. A system according to claim 7 wherein said magnet members are four in number, and two thereof are pivotally mounted to the other two thereof for said movement toward and away from said scroll strips.

9. A system according to claim 6 wherein each said magnet member comprises a plurality of discrete bar magnets.

10. A system according to claim 5 wherein said magnet means are mounted to movable carrier means to vary the effective height of said magnet means with respect to the interior of said hopper feed means.

11. A system according to claim 10 wherein said hopper feed means further includes a guide wall located generally in parallel with and adjacent the terminal end of said conveyor belt means and including hinge means pivotally mounting said movable carrier means relative to said enclosure so as to pivot toward and away from the top most edges of said side walls.

12. A system according to claim 5 and further including means for adjusting the height of said magnet means relative to said bottom wall.

13. A system according to claim 12 wherein said magnet means are mounted to carrier member means including adjustment means for movement of said magnet means in a linear direction toward and away from said bottom wall to thereby select the effective height of said magnet means.

14. A system according to claim 13 and further including means mounting said carrier means for pivotal motion relative to said hopper feed means for selectively pivoting said magnet means away from said side walls to permit access to the interior of said hopper feed means.

15. A system according to claim 1 wherein said reject means comprises an ejector finger member mounted for movement between a rest position wherein it does not interfere with the path of travel of said scroll strips along said conveyor belt means and an eject position wherein said finger extends into the path of travel of said scroll strips along said conveyor belt means for redirecting said scroll strips away from said conveyor belt means, and selectively actuatable drive means for driving said ejector finger member between said rest and eject positions thereof.

16. A system according to claim 15 and further including reject bin means located adjacent said conveyor belt means for receiving said scroll strips redirected by said ejector finger member.

17. A system according to claim 16 wherein said reject bin means comprises a box-like enclosure member having an entrance opening aligned with said ejector finger member when it is in the eject position for receiving the redirected scroll strips therethrough.

18. A system according to claim 17 wherein said reject bin means further includes a guide member adjacent said entrance opening for directing said scroll strips into an interior portion of said reject bin means and means defining a further opening in said enclosure member adjacent said guide member for receiving therethrough at least a portion of said ejector finger means so as to assure redirection of said scroll strips into said reject bin means thereby.

19. A system according to claim 15 wherein said ejector finger member comprises an elongate member pivotally mounted relative to said conveyor belt means and wherein said drive means comprises piston-and-cylinder means operatively coupled with said finger member for pivoting said ejector finger member between said rest and eject positions thereof.

20. A hopper-infeed apparatus for use in a scroll strip conveyor system including conveyor belt means for carrying a series of relatively flat scroll strips thereon in a flat, edge-to-edge spaced apart condition, comprising: hopper-infeed means located at a terminal end of said conveyor belt means and defining enclosure for receiving said scroll strips therefrom one by one in said edge-to-edge condition, and magnetic strip alignment means associated with the upper portion of the enclosure for redirecting said scroll strips into a parallel, surface-to-surface spaced apart condition and permitting the scroll strips to move along the length of said hopper-infeed means to be stacked in a flat, surface-to-surface abutting condition in a hopper; wherein said hopper-infeed means enclosure includes means defining a bottom wall and a pair of opposite side walls, said walls collectively defining a cross-sectional configuration similar to the maximum peripheral dimension of said scroll strips; entrance opening means for receiving said strips on edge from said comveyor belt means; and wherein said magnetic strip alignment means redirects said strips to said parallel spaced apart condition within said hopper-infeed means, such that the flat surfaces of said scroll strips are substantially perpendicular to said bottom and side walls.

21. Apparatus according to claim 20 wherein said hopper-infeed means further includes an entrance guide portion defining a downwardly angled orientation of the hopper relative to said conveyor bely means so as to facilitate the directing to and holding of said scroll strips in a stacked condition in said hopper by gravity.

22. Apparatus according to claim 20 wherein said magnetic strip alignment means comprises magnet members arranged with predetermined magnetic polarity orientations for magnetizing the scroll strips in such a way so as to maintain them in said parallel, spaced apart condition substantially perpendicular with the bottom and side walls of said hopper-infeed means, substantially along the extent of said hopper-infeed means and at least up to an entrance of said hopper.

23. Apparatus according to claim 22 wherein said magnet members comprises a plurality of elongate magnet members aligned with the direction of travel of said scroll strips through said hopper-infeed means and arranged in a parallel spaced apart condition along a top portion thereof and substantially parallel with said side walls thereof, each magnetic member being disposed with its respective N-S poles extending longitudinally of the strips and transversely of the path of travel of said strips through said hopper-infeed means.

24. Apparatus according to claim 23 wherein at least selected ones of said magnet members are mounted for movement, toward and away from said scroll strips so as to selectively vary the net magnet forces applied to said scroll strips.

25. Apparatus according to claim 24 wherein said magnet members are four in number, and two thereof are pivotally mounted to the other two thereof for said movement toward and away from said scroll strips.

26. Apparatus according to claim 22 wherein said magnet members are mounted to movable carrier means for movement away from said side walls to permit access to the interior of said hopper-infeed means.

27. Apparatus according to claim 26 wherein said hopper-infeed means further includes a guide wall located generally in parallel with and adjacent the terminal end of said conveyor belt means and including hinge means pivotally mounting said movable carrier means.

28. Apparatus according to claim 22 and further including means for adjusting the height of said magnet members relative to said bottom wall.

29. Apparatus according to claim 28 wherein said magnet members are mounted to a carrier member including adjustment means for movement of said magnet members in a linear direction toward and away from said bottom wall to thereby select the effective height of said hopper-infeed means.

30. Apparatus according to claim 29 and further including means mounting said carrier means for pivotal motion for selectively pivoting said magnet members from said side walls to permit access to the interior of said hopper-infeed means.

31. An ejector apparatus for use in a scroll strip conveyor system including conveyor belt means for carrying a series of relatively flat scroll strips thereon in a flat, edge-to-edge spaced apart condition, comprising: a pair of spaced apart ejector finger members mounted for movement between a rest position wherein they do not interfere with the path of travel of said scroll strips along said conveyor belt means and an eject position wherein said ejector finger members staddle a belt part of the conveyor belt means and extend into the path of travel of said scroll strips along said conveyor belt means for redirecting said scroll strips away from said conveyor belt means, and selectively actuatable drive means or driving said ejector finger members between said rest and eject positions thereof; and further including reject bin means located adjacent said conveyor belt means for receiving said scroll strips redirected by said ejector finger members; wherein said reject bin means comprises a box-like enclosure member having an entrance opening aligned with said ejector finger members when in the eject position for receiving the redirected scroll strips therethrough; and wherein said reject bin means further includes a guide member extending angularly inwardly of said entrance opening for directing said scroll strips into an interior portion of said reject bin means, and means defining a pair of further openings in said enclosure in communication with said entrance opening and extending to areas adjacent and to either side of said guide member for receiving therethrough at least a portion of said ejector finger members for straddling and aligning with said guide member so as to assure redirection of said scroll strips into said reject bin means by the cooperative action of both the ejector finger members and the guide member.

32. Apparatus according to claim 31 wherein said ejector finger members are pivotally mounted relative to said conveyor belt means and wherein said drive means comprises piston-and-cylinder means operatively coupled with said finger members for pivoting said ejector finger members between said rest and eject positions thereof.

* * * * *